US010351972B2

(12) United States Patent
She et al.

(10) Patent No.: US 10,351,972 B2
(45) Date of Patent: Jul. 16, 2019

(54) MULTIFUNCTIONAL SPINNING DEVICE

(71) Applicant: NEWORLD E & E PTY LTD., Geelong (AU)

(72) Inventors: Fenghua She, Geelong (AU); Long Tan, Geelong (AU); Lingxue Kong, Geelong (AU); Ludovic Francis Yannick Dumee, Melbourne (AU); Baoping Wei, Guangzhou (CN); Weimin Gao, Wyndham (AU); Li He, Beijing (CN)

(73) Assignee: NEWORLD E & E PTY LTD., Geelong (AU)

( * ) Notice: Subject to any disclaimer, the term of this patent is extended or adjusted under 35 U.S.C. 154(b) by 270 days.

(21) Appl. No.: 15/128,094

(22) PCT Filed: Mar. 20, 2015

(86) PCT No.: PCT/CN2015/074707
§ 371 (c)(1),
(2) Date: Sep. 21, 2016

(87) PCT Pub. No.: WO2015/139658
PCT Pub. Date: Sep. 24, 2015

(65) Prior Publication Data

US 2017/0121853 A1 May 4, 2017

(30) Foreign Application Priority Data

Mar. 21, 2014 (CN) ..... 2014 1 0108867
Mar. 21, 2014 (CN) ..... 2014 1 0108910

(51) Int. Cl.
*D01D 5/00* (2006.01)
*D01D 5/18* (2006.01)

(52) U.S. Cl.
CPC ..... *D01D 5/0061* (2013.01); *D01D 5/18* (2013.01)

(58) Field of Classification Search
None
See application file for complete search history.

(56) References Cited

U.S. PATENT DOCUMENTS

2002/0122840 A1* 9/2002 Lee ..... D01D 5/0061 425/174.6
2010/0127434 A1* 5/2010 Broos ..... B29C 47/0014 264/454

(Continued)

FOREIGN PATENT DOCUMENTS

CN 1174542 A 2/1998
CN 101542025 A 9/2009

(Continued)

OTHER PUBLICATIONS

International Search Report dated May 27, 2015 from Application No. PCT/CN2015/074707.

*Primary Examiner* — Jacob T Minskey
*Assistant Examiner* — Baileigh Kate Darnell
(74) *Attorney, Agent, or Firm* — Platinum Intellectual Property LLP

(57) ABSTRACT

The invention discloses a multifunctional spinning device, comprising a solution storage apparatus, a solution spraying apparatus, a solution delivery apparatus, a drive apparatus, a high-voltage power supply apparatus, and a fiber collecting apparatus. The device not only realizes production of micron and nano fibers with multiple structures or a mixture thereof on one device, but also greatly improves the production yield thereof, tremendously reduces a voltage value of the required high-voltage electrostatic field, even does not (Continued)

require involvement of the high-voltage electrostatic field, reduces costs, and improves production safety.

8 Claims, 11 Drawing Sheets

(56) References Cited

U.S. PATENT DOCUMENTS

| | | | | |
|---|---|---|---|---|
| 2010/0148404 | A1* | 6/2010 | Smida | D01D 5/0069 264/465 |
| 2013/0011676 | A1* | 1/2013 | Schmitz | D01D 5/18 428/373 |
| 2014/0035177 | A1* | 2/2014 | Lipton | D01D 5/18 264/8 |

FOREIGN PATENT DOCUMENTS

| | | | |
|---|---|---|---|
| CN | 102084043 | A | 6/2011 |
| CN | 102844475 | A | 12/2012 |
| WO | WO2014015843 | A1 | 1/2014 |

* cited by examiner

MULTIFUNCTIONAL SPINNING DEVICE

RELATED APPLICATIONS

This application is a United States National Stage Application filed under 35 U.S.C 371 of PCT Patent Application Serial No. PCT/CN2015/074707, filed Mar. 20, 2015, which claims Chinese Patent Application Serial No. CN 201410108910.1 and 201410108867.9, filed Mar. 21, 2014, the disclosure of all of which are hereby incorporated by reference in their entirety.

FIELD OF THE INVENTION

The present invention belongs to the technical field of spinning, and in particular to a multifunctional spinning device.

BACKGROUND OF THE INVENTION

Nano fibers are a fiber material having the diameter less than hundreds of nanometers.

Fibers may be divided into single-component, two-component and multi-component fibers according to cross-section structures. The single-component fibers are fibers constituted on the cross-sections thereof by one material or a uniform mixture of several materials. The two-component fibers are fibers having a certain special regional structure relation on the cross-sections thereof constructed by two materials with different components. The two-component fibers and the multi-component fibers fall into the scope of composite fibers, wherein each component may be a single material or a mixture of several materials. By a structure relation between the two components, the two-component fibers may be divided into fibers of a bilateral (also referred to as conjugated) structure, fibers of a core-shell (also referred to as shell-core or core-sheath or concentric or coaxial) structure, fibers of a sea-islands structure, tip-covered fibers, segmented fibers and the like.

The nano fibers are extremely high in specific surface area and transverse-longitudinal ratio. For example, fabrics woven using the nano fibers are fine in structure, extremely high in porosity, and excellent in flexibility, absorptivity, filterability, adhesivity, heat retaining property and mechanical strength. These unique characteristics allow novel properties of the nano fibers that micron fibers lack, and the nano fibers thus have been extensively applied in a variety of fields. In recent years, scientists have found that by combining the two-component or multi-component composite micron and nano fibers having special cross-section structures, i.e., two materials having different properties, micron and nano fibers having completely new properties that many single-component fibers lack or better properties than those of the single-component fibers. The two-component or multi-component composite micron and nano fibers have more favorable application prospect in many important high-end fields, for example, such fields as protective clothing, biomedical articles (tissue scaffold structures, artificial human body organs, wound dressings, medicine release, etc.), membrane materials, filter media, catalysts, electronic products, energy storage and composite reinforcing materials.

At present, a traditional textile device is able to produce the two-component micron fibers, but fails to realize large-batch and low-cost production of the single-component, two-component and multi-component micron and nano fibers with various structures on one machine. At present, a spinning device for producing the single-component, two-component and multi-component micron and nano fibers with various structures mainly employs a needle electrostatic spinning method. Briefly, in the needle electrostatic spinning technique, a high-voltage power source produces a high-voltage electrostatic field between needles of syringes filled with spinning solutions and an electrically conductive collecting apparatus such that the spinning solutions in the syringes are sprayed from the needles by overcoming surface tension under the action of the high-voltage electrostatic field to form nano fibers on the collecting apparatus. Nevertheless, the needle electrostatic spinning method is extremely low in yield, requires high voltages resulting in high work safety risk and high cost, and additionally may be greatly influenced by such properties as the concentration and viscosity of the solution and cannot be easily produced at a large scale.

SUMMARY OF THE INVENTION

The technical problem to be solved by the present invention is to provide a multifunctional spinning device that tremendously reduces a voltage value of the high-voltage electrostatic field required by spinning, event does not require the involvement of the high-voltage electrostatic field, thereby greatly reducing the production and energy consumption costs, realizes production of micron and nano fibers with multiple structures or a mixture thereof on one device, and has the characteristics of high safety property, high yield and extensive applicability.

In order to solve the above technical problem, the present invention provides a multifunctional spinning device, which is characterized by including a solution storage apparatus, a solution delivery apparatus, a solution spraying apparatus, a drive apparatus and a fiber collecting apparatus. Specifically, the solution storage apparatus is used for storing spinning solutions. Space for solution storage in the solution storage apparatus is formed by several drums arranged in a coaxial nesting manner and a sealing plate. The several drums include at least an inner drum and an outer drum. The outer drum sleeves the peripheral part of the inner drum, and the bottom of the inner drum and the bottom of the outer drum are fixedly connected with an upper surface of the sealing plate, respectively. The inner drum and the sealing plate form an inner solution storage chamber. The inner drum, the outer drum and the sealing plate form an outer solution storage chamber. Vertical central axes of the outer drum and the inner drum both are located in a same straight line L1. The solution delivery apparatus communicates with the solution storage apparatus and is used for delivering the spinning solutions to the solution storage apparatus. The solution spraying apparatus is connected to the solution storage apparatus and used for spraying the spinning solutions, and includes several spray passage opening groups, discharge orifice groups as many as the spray passage opening groups, and spray passage pipe groups as many as the discharge orifice groups. Each spray passage opening group is composed of an inner spray passage opening and an outer spray passage opening. Each discharge orifice group is composed of an inner discharge orifice and an outer discharge orifice. Each spray passage pipe group is composed of a pipe middle portion for delivering the spinning solution and a pipe tail portion for spraying the spinning solution. Each pipe middle portion connects the corresponding spray passage opening with the corresponding pipe tail portion into a whole. Each inner discharge orifice is formed in a sidewall of the inner drum. Each outer discharge orifice is formed in a sidewall of the outer drum. One end of each inner spray passage opening communicates with the corresponding inner discharge orifice. The other end of each inner spray passage opening is formed outside the sidewall of the inner drum or passes through the outer discharge orifice and is formed outside the sidewall of the outer drum or located in the sidewall of the outer drum. One end of each outer spray passage opening communicates with the corresponding outer discharge orifice. Each outer spray passage opening is formed outside the sidewall of the outer drum or located in the sidewall of the outer drum, and surrounds the other end of the corresponding spray passage opening. One end of each pipe middle portion is connected to the other end of the corresponding inner spray passage opening and the other end of the corresponding outer spray passage opening, respectively, and the other end of the pipe middle portion is connected to one end of the corresponding pipe tail portion. The drive apparatus is used for driving the solution storage apparatus to rotate such that micron and nano fibers are sprayed from spinning materials in the solution storage apparatus under the action of a centrifugal force of rotation, and coupled with the solution storage apparatus and further connected to an external power output device. The fiber collecting apparatus is used for collecting the micron and nano fibers and disposed around a peripheral part of the solution spraying apparatus.

Optionally, in the case that several discharge orifice groups, several spray passage opening groups and several spray passage pipe groups are provided in the solution spraying apparatus, the several discharge orifice groups are distributed in the sidewalls of the inner drum and the outer drum in a circle of a same layer or in circles of several layers, while the several spray passage opening groups are distributed in the sidewalls of the inner drum and the outer drum in a circle of a same layer or in circles of several layers, and the several spray passage pipe groups are distributed on the sidewalls of the inner drum and the outer drum in a circle of a same layer or in circles of several layers.

Optionally, the device further includes a housing that includes an outer cover and an isolation plate. The isolation plate is fixed at a middle lower layer part of the outer cover and used for dividing the outer cover into an upper isolation layer and a lower isolation layer. The solution storage apparatus is disposed in the upper isolation layer, while the drive apparatus is disposed in the lower isolation layer.

Optionally, the straight line L1 is perpendicular to the upper surface of the sealing plate. Inner space of the inner drum is isolated from inner space of the outer drum. The drive apparatus is connected to the solution storage apparatus and drives the inner drum, the outer drum and the sealing plate to rotate coaxially by means of the external power output device. The solution delivery apparatus communicates with the inner solution storage chamber and the outer solution storage chamber, respectively. Each outer discharge orifice and each inner discharge orifice are arranged coaxially with a diameter of the outer discharge orifice greater than a diameter of the inner discharge orifice. Central axes of the inner spray passage opening and the outer spray passage opening are distributed at an included angle $\alpha$ to the straight line L1, wherein $0° < \alpha < 180°$.

Optionally, when the micron and nano fibers collected by collection plates are constituted by the spinning material in the inner solution storage chamber, each pipe middle portion is composed of a first inner passage and a first outer passage, while each pipe tail portion is formed by a hollow passage, and the first outer passage is in a sealed condition. One end of the first inner passage communicates with the corresponding inner discharge orifice, while the other end of the first inner passage communicates with the hollow passage. The spinning material in the inner solution storage chamber is sprayed out of a tail end of each hollow passage successively through each inner discharge orifice and each first inner passage.

Optionally, when the micron and nano fibers collected by the collection plates are constituted by the spinning material in the outer solution storage chamber, each pipe middle portion is composed of a first inner passage and a first outer passage, while each pipe tail portion is formed by a hollow passage, and the first inner passage is in a sealed condition. One end of the first outer passage communicates with the corresponding outer discharge orifice, while the other end of the first outer passage communicates with the hollow passage. The spinning material in the outer solution storage chamber is sprayed out of a tail end of each hollow passage successively through each outer discharge orifice and each first outer passage.

Optionally, when the micron and nano fibers collected by the collection plates are composite micron and nano fibers of a bilateral structure, each pipe middle portion is composed of a first inner passage and a first outer passage, while each pipe tail portion is composed of a second inner passage and a second outer passage, and the second inner passage and the second outer passage form a passage of a bilateral parallel structure. The spinning material in the inner solution storage chamber is sprayed out of a tail of each second inner passage successively through each inner discharge orifice, each first inner passage and each second inner passage, while the spinning material in the outer solution storage chamber is sprayed out of a tail of each second outer passage successively through each outer discharge orifice, each first outer passage and each second outer passage.

Optionally, when the micron and nano fibers collected by the collection plates are composite micron and nano fibers of a core-shell structure, each pipe middle portion is composed of a first inner passage, and a first outer passage, while each pipe tail portion is composed of a second inner passage and a second outer passage, and the second inner passage and the second outer passage form a passage of the core-shell structure with the second inner passage encompassed by the second outer passage. The spinning material in the inner solution storage chamber is sprayed out of a tail of each second inner passage successively through each inner discharge orifice, each first inner passage and each second inner passage, while the spinning material in the outer solution storage chamber is sprayed out of a tail of each second outer passage successively through each outer discharge orifice, each first outer passage and each second outer passage.

Optionally, when the micron and nano fibers collected by the collection plates are composite micron and nano fibers of a sea-islands structure, each pipe middle portion is composed of a first inner passage and a first outer passage, while each pipe tail portion is composed of a second inner passage and a second outer passage, and the second inner passage includes several island passages arranged in parallel with any two island passages having their sidewalls not in contact with each other. The several island passages are encompassed by the second outer passage. The spinning material in the inner solution storage chamber is sprayed out of tails of the corresponding island passages successively through each inner discharge orifice, each first inner passage and each island passage, while the spinning material in the outer solution storage chamber is sprayed out of a tail of each second outer passage successively through each outer discharge orifice, each first outer passage and each second outer passage.

Optionally, when the micron and nano fibers collected by the collection plates are composite micron and nano fibers of a tip-covered structure, each pipe middle portion is composed of a first inner passage and a first outer passage, while each pipe tail portion is composed of a second inner passage and a second outer passage, and the second inner passage is provided with several tips at a cross-section thereof, while the second outer passage includes several sub-passages arranged in parallel with any two sub-passages isolated from each other. Each sub-passage is arranged in parallel to the corresponding second inner passage, respectively, and located around one tip of the second inner passage, with the number of the sub-passages identical to the number of the tips at the cross-section of the second inner passage. The spinning material in the inner solution storage chamber is sprayed out of a tail of each second inner passage successively through each inner discharge orifice, each first inner passage and each second inner passage, while the spinning material in the outer solution storage chamber is sprayed out of tails of the corresponding sub-passages successively through each outer discharge orifice, each first outer passage and each sub-passage.

Optionally, when the micron and nano fibers collected by the collection plates are composite micron and nano fibers of a segmented structure, each pipe middle portion is composed of a first inner passage and a first outer passage, while each pipe tail portion is composed of a second inner passage and a second outer passage, and the second inner passage includes several inner sub-passages arranged in parallel with any two inner sub-passages isolated from each other and having sidewalls not in contact with each other. Sidewalls of all the inner sub-passages are closely encompassed by a tail of the second outer passage such that the tail of the second outer passage is divided into several outer sub-passages by the sidewalls of the several inner sub-passages arranged in parallel, and the several inner sub-passages and the several outer sub-passages are arranged alternately into a segmented form. The spinning material in the inner solution storage chamber is sprayed out of a tail of each inner sub-passage successively through each inner discharge orifice and each first inner passage, while the spinning material in the outer solution storage chamber is sprayed out of a tail of each second outer inner-passage successively through each outer discharge orifice and each first outer passage.

Optionally, the solution delivery apparatus includes a first solution infusion set, a first solution infusion pipe, a second solution infusion set and a second solution infusion pipe. The first solution infusion set communicates with the inner solution storage chamber by means of the first solution infusion pipe. The second solution infusion set communicates with the outer solution storage chamber by means of the second solution infusion pipe. And/or, the drive apparatus includes a motor, a rotating speed controller and a bearing coupling mechanism. The motor is connected to the rotating speed controller, and connected, by means of a bearing arranged therein and the bearing coupling mechanism in order, to the surface of the sealing plate. The motor and/or the rotating speed controller are/is connected to the external power output device. The drive apparatus is disposed above or below the solution storage apparatus. And/or, the fiber collecting apparatus includes collection plates distributed around the peripheral part of the solution spraying apparatus and a supporting base for supporting the collection plates. The supporting base is provided with several sliding grooves. The collection plates are mounted in the various sliding grooves to realize regulation of relative distances of the collection plates away from the outer drum.

Optionally, the device further includes a high-voltage power supply apparatus used for providing a high-voltage electrostatic field force to the spinning materials in the solution storage apparatus to produce micron and nano fibers with multiple structures or a mixture thereof from the spinning materials under the combined action of the electrostatic field force and the centrifugal force. The high-voltage power supply apparatus includes a high-voltage power source and a conducting electrode. One end of the high-voltage power source is connected to one end of the conducting electrode, while the other end of the high-voltage power source is grounded. The other end of the conducting electrode is at least capable of achieving current conduction with the spinning material in one solution storage chamber or the spinning material in the solution spraying apparatus.

Optionally, the fiber collecting apparatus is a conductor at least in part, and grounded.

Optionally, a conductor is provided on at least part of the surface of the inner drum, the outer drum or the sealing plate such that a current in the conducting electrode is capable of conducting to the spinning materials in the inner solution storage chamber and the outer solution storage chamber; or, a conductor is at least provided on part of the surface of each spray passage pipe in the solution spraying apparatus such that the current in the conducting electrode is capable of conducting to the spinning materials in the inner solution storage chamber and the outer solution storage chamber.

In the multifunctional spinning device provided by the present invention, spinning materials of different types or different properties are correspondingly poured into the inner solution storage chamber and the outer solution storage chamber by the solution delivery apparatus, respectively, and the drive apparatus is powered on by the power source so as to drive the inner solution storage chamber and the outer solution storage chamber to rotate at a high speed; additionally, the high-voltage power supply apparatus may also be added to provide the electrostatic field force between the spinning materials and the collecting apparatus. One end of the high-voltage power source in the high-voltage power supply apparatus is connected to a conducting electrode such that a high-voltage current conducts to the spinning materials in the solution storage apparatus via the other end of the conducting electrode; the other end of the high-voltage power source and the fiber collecting apparatus are grounded, respectively. The spinning materials poured into the inner solution storage chamber and the outer solution storage chamber are sprayed out of the tail ends of the pipe tail portions after successively passing through the inner and outer spray passage openings in the spray passage opening groups and the pipe middle portions under the combined action of the centrifugal force of rotation provided by the drive apparatus and/or the electrostatic field force provided by the high-voltage power supply apparatus; with the volatilization of the solvent, the spinning solutions are solidified to form fibers deposited on the fiber collecting apparatus, thereby producing a large quantity of micron and nano fibers or a mixture thereof. Compared with the traditional spinning technique, in the present invention, the combined acting force of the centrifugal force of rotation provided by the drive apparatus and/or the electrostatic field force provided by the high-voltage power supply apparatus is provided as power for the formation of the micron and nano fibers, and the solution spraying apparatus with various structures is adopted. As a result, the device not only realizes production of micron and nano fibers with multiple structures or the mixture thereof on one device, but also greatly improves the production yield thereof, tremendously reduces the voltage value of the required high-voltage electrostatic field, even does not require involvement of the high-voltage electrostatic field, reduces the production and energy costs, improves the production safety, and meets the requirements of large-scale production of the micron and nano fibers of multiple structures and the mixture thereof.

BRIEF DESCRIPTION OF DRAWINGS

In order to more clearly describe the technical solutions in the embodiments of the present invention or the prior art, accompanying drawings required for use in the embodiments will be simply introduced below. It is apparent that the accompanying drawings in the following description are merely some embodiments of the present invention, and for those of ordinary skill in the art, other accompanying drawings may also be obtained according to these accompanying drawings without creative work.

Figure 1:
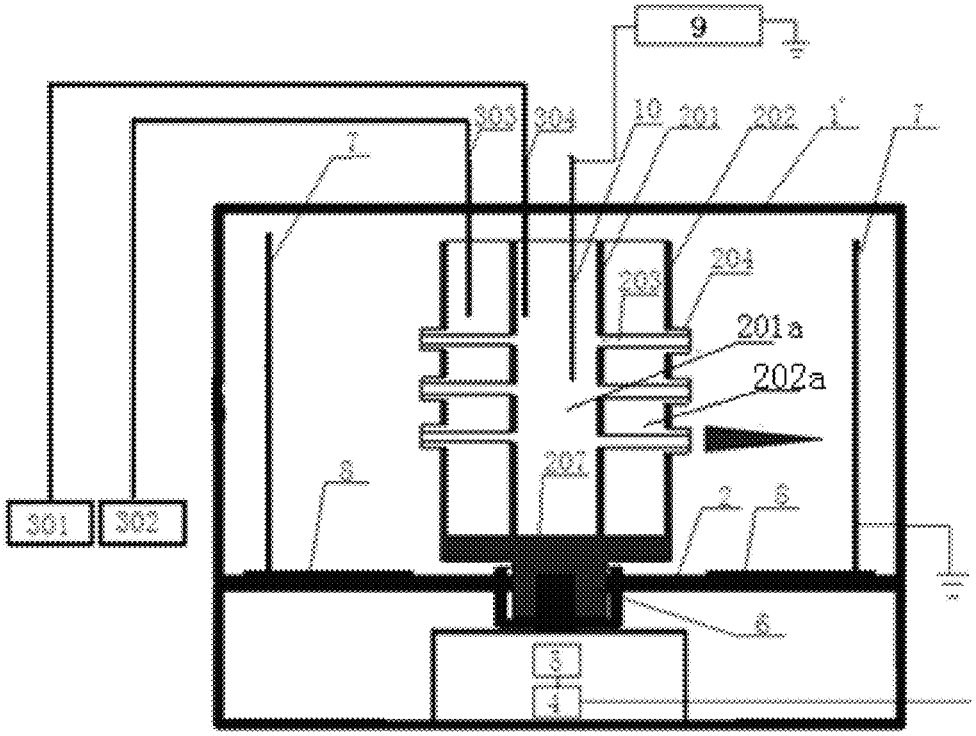
FIG. 1 is a schematic diagram of an overall structure of an electrostatic centrifugal multifunctional micron and nano fiber spinning device provided by an embodiment of the present invention.

In the drawings, what the reference signs represent are as follows: 1-outer cover, 2-isolation plate, 4-motor, 5-rotating speed controller, 6-bearing coupler, 7-collection plate, 8-supporting base, 9-high-voltage power supply apparatus, 10-conducting electrode, 11-stiffener, 201-inner drum, 202-outer drum, 203-inner spray passage opening, 204-outer spray passage opening, 205-pipe middle portion, 206-pipe tail portion, 207-sealing plate, 301-first solution infusion set, 302-second solution infusion set, 303-first solution infusion pipe, and 304-second solution infusion pipe.

DETAILED DESCRIPTION OF THE EMBODIMENTS

The technical solutions in the embodiments of the present invention will be described below clearly and completely in conjunction with the accompanying drawings in the embodiments of the present invention. It is apparent that the described embodiments are merely a part, rather than all of the embodiments of the present invention. All the other embodiments obtained by those of ordinary skill in the art on the basis of the embodiments of the present invention also fall into the scope of protection of the present invention.

Figure 2:
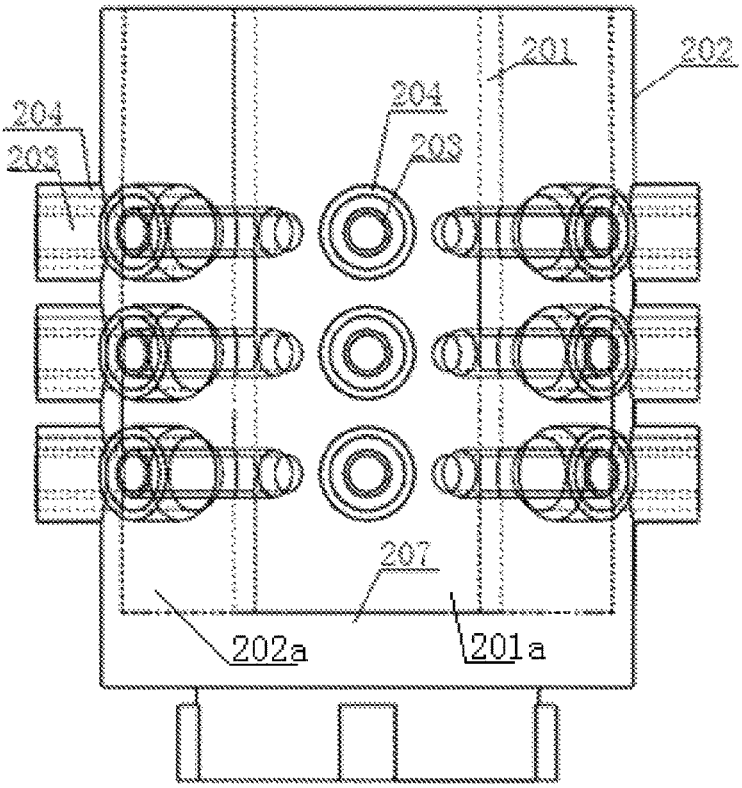
FIG. 2 is a schematic diagram of partial structures of a solution storage apparatus and a solution delivery apparatus provided in an embodiment of the present invention.

With reference to FIGS. 1 and 2, an electrostatic-centrifugal multifunctional micron and nano fiber spinning device is provided by an embodiment of the present invention, which is characterized by high yield and low cost and capable of realizing the production of various single-component, two-component and multi-component micron and nano fibers. The device includes a housing, a solution storage apparatus, a solution delivery apparatus, a solution spraying apparatus, a drive apparatus, a fiber collecting apparatus, and a high-voltage power supply apparatus.

Specifically, the solution storage apparatus is used for storing spinning solutions, and space for solution storage in the solution storage apparatus is formed by several drums arranged in a coaxial nesting manner (one drum sleeves another drum). The vertical central axis of each drum is located in the same straight line L1, i.e., all the drums share one single vertical central axis. The solution storage apparatus is disposed in the housing. Each drum and a corresponding sealing plate 207 form a solution storage chamber for storing a spinning solution of a certain component, and respective solution storage chambers are independent of each other (isolated). Optionally, the number of the drums can be 2 (two drums may be selected for producing two-component fibers, three drums may be selected for producing three-component fibers, and so on), i.e., including an inner drum 201 and an outer drum 202. The bottom of the inner drum 201 and the bottom of the outer drum 202 are fixedly connected with the upper surface of the sealing plate 207, respectively. The inner drum 201 and the sealing plate 207 form an inner solution storage chamber 201*a*. The inner drum 201, the outer drum 202 and the sealing plate 207 form an outer solution storage chamber 202*a*. The solution delivery apparatus is used for delivering the spinning solutions of different components into corresponding solution storage chambers, and communicates with each drum in the solution storage apparatus. The solution spraying apparatus is used for spraying the spinning solutions, and includes at least one spray passage opening group, discharge orifice groups as many as the spray passage opening groups, and spray passage pipe groups as many as the discharge orifice groups. Each spray passage opening group is composed of an inner spray passage opening 203 and an outer spray passage opening 204. Each discharge orifice group is composed of an inner discharge orifice and an outer discharge orifice. Each spray passage pipe group is composed of a pipe middle portion 205 for delivering the spinning solution and a pipe tail portion 206 for spraying the spinning solution. Each inner discharge orifice is formed in a sidewall of the inner drum 201. Each outer discharge orifice is formed in a sidewall of the outer drum 202. One end of each inner spray passage opening 203 communicates with the corresponding inner discharge orifice. The other end of each inner spray passage opening 203 passes through the outer discharge orifice and is formed outside the sidewall of the outer drum 202. One end of each outer spray passage opening 204 communicates with the corresponding outer discharge orifice. Each outer spray passage opening 204 is formed outside the sidewall of the outer drum 202, and surrounds the other end of the corresponding spray passage opening 203. One end of each pipe middle portion 205 is connected to the other end of the corresponding inner spray passage opening 203 and the other end of the corresponding outer spray passage opening 204, respectively, and the other end of the pipe middle portion 205 is connected to one end of the corresponding pipe tail portion 206. The drive apparatus is used for driving the solution storage apparatus to rotate, and coupled with the bottom of the solution storage apparatus and further connected to an external power output device. The fiber collecting apparatus is used for collecting the micron and nano fibers and disposed around a peripheral part of the solution spraying apparatus, and further is connected to the ground as a negative electrode. The high-voltage power supply apparatus is used for providing an electrostatic field force to the spinning solutions in the solution storage apparatus. One end of the high-voltage power supply apparatus is disposed in the solution storage apparatus, while the other end of the high-voltage power supply apparatus is grounded. During actual operation, the drive apparatus drives each drum in the solution storage apparatus to rotate by connecting to an external power output device, and meanwhile, the spinning solutions of different components delivered from the solution delivery apparatus are correspondingly poured into the corresponding solution storage chambers in the solution storage apparatus. One end (serving as a positive electrode) of the high-voltage power supply apparatus is disposed in the solution storage apparatus, while the other end (serving as a negative electrode) of the high-voltage power supply apparatus is grounded. Additionally, the solution storage apparatus, each pipe tail portion 206 (or the tail end of the pipe tail portion 206) and the fiber collecting apparatus may be made of electrically conductive materials or internally provided with electrically conductive strips or coatings, or the like, respectively, to realize current conduction between the interior of the solution storage apparatus and the pipe tail portion 206, thereby producing the electrostatic field force between the tail end of the pipe tail portion 206 and the fiber collecting apparatus. Under the combined action of the electrostatic field force and the centrifugal force of rotation, the spinning solutions poured into the solution storage chamber are sprayed out of the tail end of each pipe tail portion 206 successively through each discharge orifice group, each spray passage opening group and each pipe middle portion 205, and drawn and solidified to form the micron and nano fibers of various structures.

It needs to be noted that the production of single-component, two-component and multi-component micron and nano fibers of various structures can be implemented by changing the passage structures in each pipe middle portion 205 and each pipe tail portion 206 in the present embodiment. Moreover, the solution spraying apparatuses of different structures are connected to the wall of the solution storage apparatus in the circumferential or height direction, respectively, allowing simultaneous production of a mixture of various micron and nano fibers.

In the present embodiment, one or several discharge orifice groups, spray passage opening groups and spray passage pipe groups can be provided in the solution spraying apparatuses. In the case that several discharge orifice groups, several spray passage opening groups and several spray passage pipe groups are provided, the several discharge orifice groups are distributed in the sidewalls of the inner drum 201 and the outer drum 202 in a circle of a same layer, while the several spray passage opening groups are distributed in the sidewalls of the inner drum 201 and the outer drum 202 in a circle of a same layer, and the several spray passage pipe groups are correspondingly distributed on the sidewalls of the inner drum 201 and the outer drum 202 in a circle of a same layer; in addition, the several discharge orifice groups are distributed in the sidewalls of the inner drum 201 and the outer drum 202 in circles of several layers, while the several spray passage opening groups are distributed in the sidewalls of the inner drum 201 and the outer drum 202 in circles of several layers, and the several spray passage pipe groups are correspondingly distributed on the sidewalls of the inner drum 201 and the outer drum 202 in circles of several layers.

In the present embodiment, the housing includes an outer cover 1 and an isolation plate 2, wherein the isolation plate 2 is fixed at a middle lower layer part of the outer cover 1 and used for dividing the outer cover I into an upper isolation layer and a lower isolation layer. The solution storage apparatus is disposed in the upper isolation layer, while the drive apparatus is disposed in the lower isolation layer. Additionally, a connecting through groove is formed in a central part of the isolation plate 2. The drive apparatus is coupled with the bottom of the solution storage apparatus by means of the connecting through groove, and thus drives the solution storage apparatus to rotate by means of the external power output device.

In this embodiment, the solution storage apparatus further includes the sealing plate 207, wherein the inner drum 201 and the outer drum 202 are distributed in the nesting manner (the outer drum 202 sleeves the inner drum 201), and the bottom of the inner drum 201 and the bottom of the outer drum 202 are fixedly connected to the upper surface of the sealing plate 207, respectively. The vertical central axes (the straight line L1) of the inner drum 201 and the outer drum 202 are perpendicular to the upper surface of the sealing plate 207. Inner space of the inner drum 201 is isolated from that of the outer drum 202. The drive apparatus is connected to the lower surface of the sealing plate through an isolation plate 2, and drives the inner drum 201, the outer drum 202 and the sealing plate 207 to synchronously rotate by means of the external power output device. The inner drum 201 and the outer drum 202 are connected to the solution delivery apparatus, respectively, such that the spinning solutions of different components are correspondingly poured into the inner solution storage chamber 201*a* and the outer solution storage chamber 202*a*. Additionally, the diameter of each outer discharge orifice is greater than the diameter of each discharge orifice. The central axes of each inner spray passage opening 203 and each outer spray passage opening 204 both are in a straight line L2. The straight line L2 and the straight line L1 are distributed at an included angle $\alpha$, wherein $0° < \alpha < 180°$.

In this embodiment, the drive apparatus may include a (high speed) motor 4, a rotating speed controller 5 and a bearing coupler 6, wherein the motor 4 is connected to the rotating speed controller 5, and connected to the sealing plate 207 by means of a bearing arranged in the motor 4 and the bearing coupler 6 in order. Optionally, a supporting plate may also be additionally disposed at the tops of the inner drum 201 and the outer drum 202. The motor 4 and the rotating speed controller 5 are arranged on the added supporting plate. That is, the motor 4 and the rotating speed controller 5 are located above the inner drum 201 and the outer drum 202. Finally, the motor 4 or the rotating speed controller 5 is connected to the external power output device. The rotating speed controller 5 appropriately regulates the speed of the motor 4, and then the motor 4 drives the inner drum 201 and the outer drum 202 to rotate at a high speed.

In this embodiment, the solution delivery apparatus may include a first solution infusion set 301, a first solution infusion pipe 303, a second solution infusion set 302 and a second solution infusion pipe 304. The first solution infusion set 301 communicates with the inner drum 201 by means of the first solution infusion pipe 303. The second solution infusion set 302 communicates with the outer drum 202 by means of the second solution infusion pipe 304.

In this embodiment, the fiber collecting apparatus may include collection plates 7 distributed around the peripheral part of the solution spraying apparatus and the supporting base 8 for supporting the collection plates 7. Preferably, the collection plates 7 may be cylindrical. The supporting base 8 is provided with several sliding grooves. The cylindrical collection plates 7 are mounted in the various sliding grooves to realize regulation of relative distances of the cylindrical collection plates 7 away from the outer drum 202. Furthermore, the collection plates 7 are grounded as negative electrodes. The cylindrical collection plates 7 are perpendicular to the sealing plate 207 or the isolation plate 2. Preferably, the relative distances of the surfaces of the cylindrical collection plates 7 away from the tail ends of the pipe tail portion 206 are greater than 10 mm. Additionally, the fiber collecting apparatus may also be multiple battens arranged perpendicularly to the sealing plate 207. Each batten may be disposed in each of a plurality of sliding grooves of the supporting base to realize regulation of the relative distances of the collection plates from the outer drum 202.

In this embodiment, the high-voltage power supply apparatus may include a high-voltage power supply source 9 and a current-conducting rod 10 (a conducting electrode). The positive electrode of the high-voltage power supply source 9 is electrically connected to one end of the current-conducting rod 10. The negative electrode of the high-voltage power supply source 9 is grounded. The other end of the current-conducting rod 10 is inserted into any drum in the solution storage apparatus. Preferably, the inner drum 201, the outer drum 202., each pipe tail portion 206 (or the tail end of the pipe tail portion 206) and the collection plates 7 in this embodiment may be made of electrically conductive materials or provided with electrically conductive strips or coatings, or the like therein, respectively, to realize current conduction between the inner drum 201 and the outer drum 202 and between the pipe tail portion 206 and the collection plates 7. Furthermore, in order to prevent the electrostatic field force produced between the tail end of each pipe tail portion 206 and the collection plates 7 from being influenced by the electric field force formed on the outer wall of the outer drum 202, an insulating layer is preferably formed on the outer wall of the outer drum 202.

In this embodiment, the inner drum 201 and the outer drum 202 may both he of a hollow cylindrical structure or a hollow cone-shaped structure.

During actual operation, by changing the passage structures in each pipe middle portion 205 and the pipe tail portion 206 in this embodiment according to actual operation requirements, single-component, two-component and multi-component micron and nano fibers of various structures may be produced. Moreover, the solution spraying apparatuses of different structures are connected to the wall of the solution storage apparatus in the circumferential or height direction, respectively, allowing simultaneous production of a mixture of various micron and nano fibers, as specifically described below.

Figure 3:
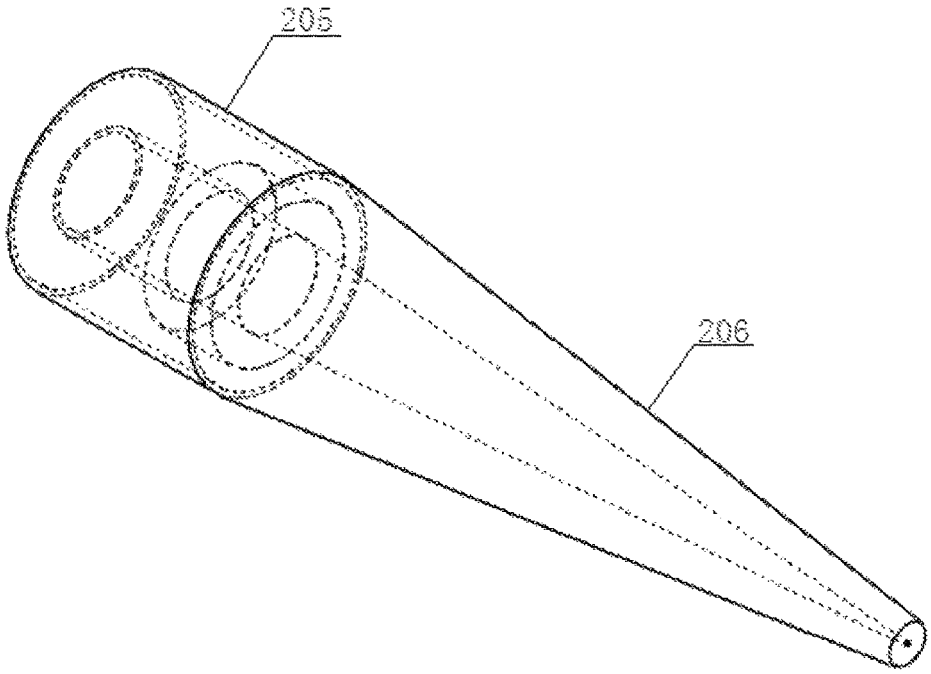
FIG. 3 is a perspective view of a structure relation between a pipe middle portion and a pipe tail portion provided in an embodiment of the present invention when micron and nano fibers collected by collection plates are constituted by a spinning solution in an inner solution storage chamber.
Figure 4:
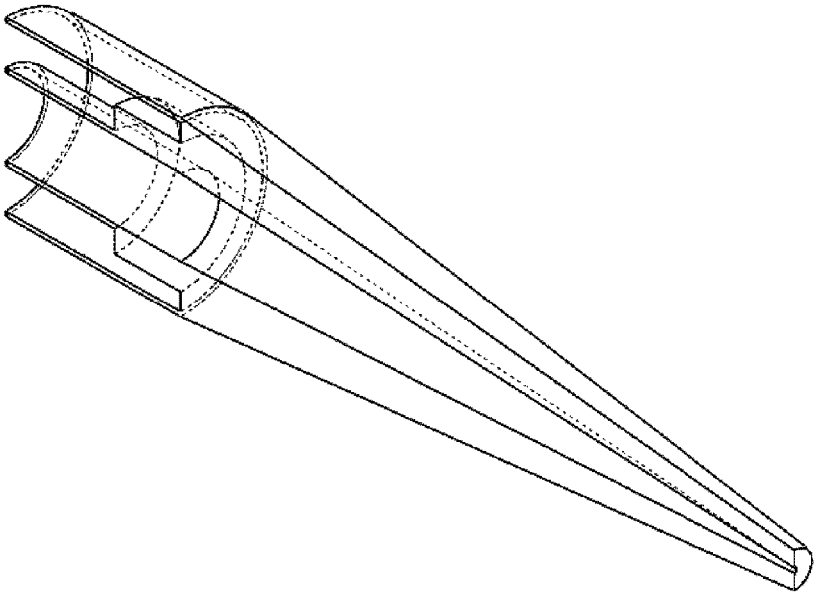
FIG. 4 is an axial sectional view of the structure relation between the pipe middle portion and the pipe tail portion provided in the embodiment of the present invention when the micron and nano fibers collected by the collection plates are constituted by the spinning solution in the inner solution storage chamber.

1. When the micron and nano fibers collected by the collection plates 7 are constituted by the spinning solution in the inner solution storage chamber 201*a*, with reference to FIGS. 3 and 4, each pipe middle portion 205 is composed of a first inner passage and a first outer passage, while each pipe tail portion 206 is formed by a hollow passage, and the first outer passage is in a sealed condition. One end of the first inner passage communicates with the corresponding inner discharge orifice, while the other end of the first inner passage communicates with the hollow passage. In this case, under the action of the centrifugal force, the spinning solution in the inner solution storage chamber 201*a* is sprayed out of the tail end of each hollow passage successively through each inner discharge orifice and each first inner passage, thereby obtaining the single-component micron and nano fibers constituted by the spinning solution in the inner drum 201. In addition, the single-component micron and nano fibers having various sectional shapes and sizes may be produced by changing the sectional shape and the size of the tail end of each hollow passage.

Figure 5:
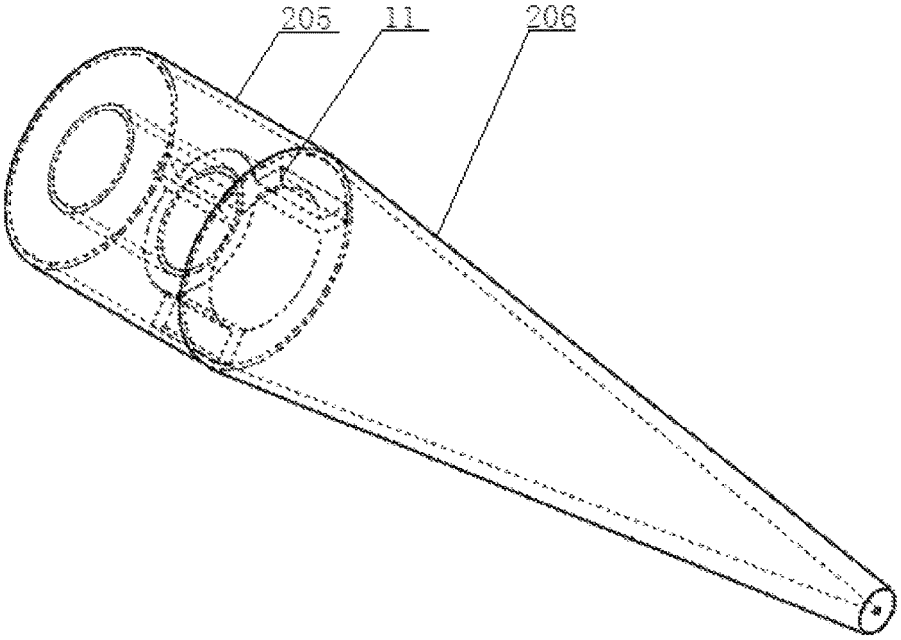
FIG. 5 is a perspective view of a structure relation between a pipe middle portion and a pipe tail portion provided in an embodiment of the present invention when micron and nano fibers collected by collection plates are constituted by a spinning solution in an outer solution storage chamber.
Figure 6:
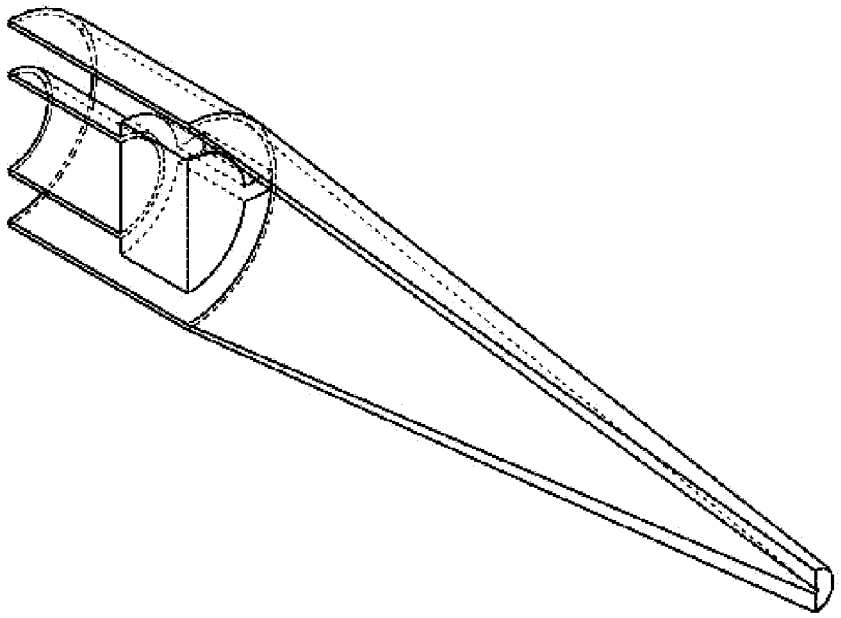
FIG. 6 is an axial sectional view of the structure relation between the pipe middle portion and the pipe tail portion provided in the embodiment of the present invention when the micron and nano fibers collected by the collection plates are constituted by the spinning solution in the outer solution storage chamber.

2. When the micron and nano fibers collected by the collection plates 7 are constituted by the spinning solution in the outer solution storage chamber 202*a*, with reference to FIGS. 5 and 6, each pipe middle portion 205 is composed of a first inner passage and a first outer passage, while each pipe tail portion 206 is formed by a hollow passage, and the first inner passage is in a sealed condition. One end of the first outer passage communicates with the corresponding outer discharge orifice, while the other end of the first outer passage communicates with the hollow passage. In this case, under the action of the centrifugal force, the spinning solution in the outer solution storage chamber 202*a* is sprayed out of the tail end of each hollow passage successively through each outer discharge orifice and each first outer passage, thereby obtaining the single-component micron and nano fibers constituted by the spinning solution in the outer solution storage chamber 202*a*. In addition, the single-component micron and nano fibers having various sectional shapes and sizes may be produced by changing the sectional shape and the size of the tail end of each hollow passage.

Figure 7:
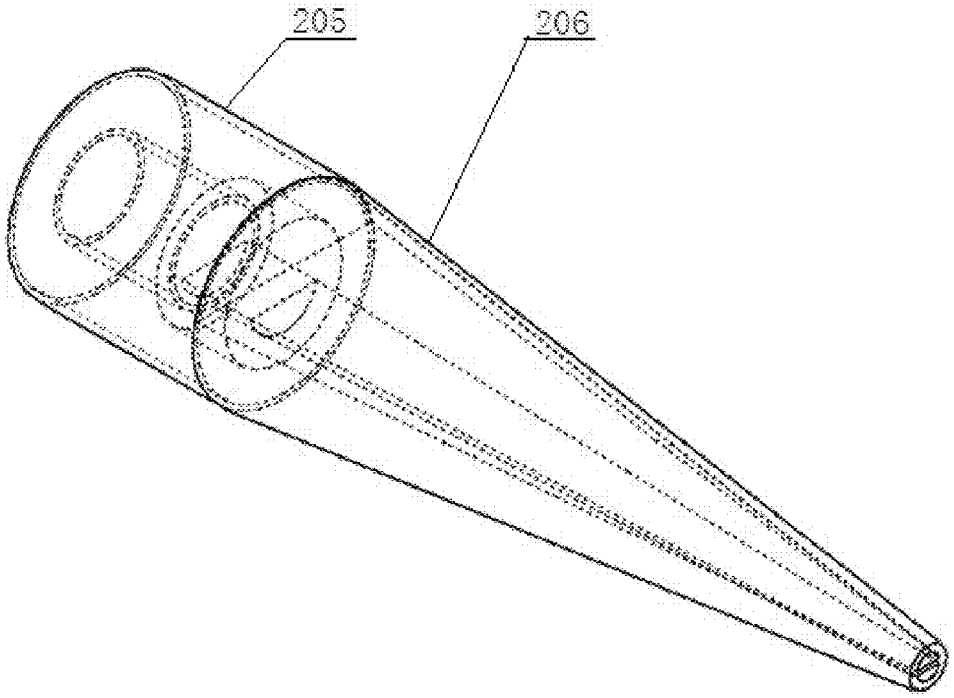
FIG. 7 is a perspective view of a structure relation between a pipe middle portion and a pipe tail portion provided in an embodiment of the present invention when micron and nano fibers collected by collection plates are composite micron and nano fibers of a bilateral structure.
Figure 8:
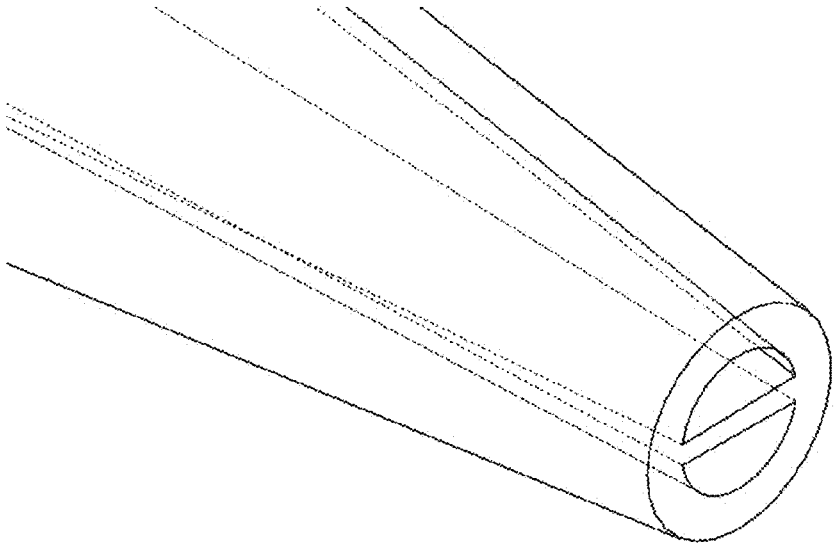
FIG. 8 is a schematic diagram of an enlarged partial structure of the pipe tail portion provided in the embodiment of the present invention when the micron and nano fibers collected by the collection plates are the composite micron and nano fibers of the bilateral structure.
Figure 9:
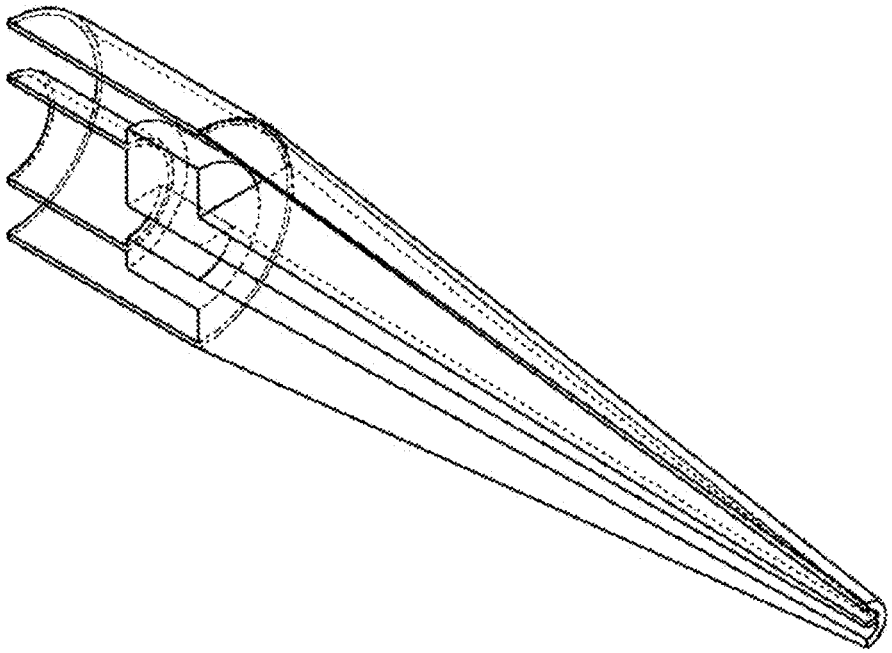
FIG. 9 is an axial sectional view of the structure relation between the pipe middle portion and the pipe tail portion provided in the embodiment of the present invention when the micron and nano fibers collected by the collection plates are the composite micron and nano fibers of the bilateral structure.

3. When the micron and nano fibers collected by the collection plates 7 are composite micron and nano fibers of a bilateral structure, with reference to FIGS. 7-9, each pipe middle portion 205 is composed of a first inner passage and a first outer passage, while each pipe tail portion 206 is composed of a second inner passage and a second outer passage, and the second inner passage and the second outer passage form a passage of a bilateral parallel structure. In this case, under the action of the centrifugal force, the spinning solution in the inner solution storage chamber 201*a* is sprayed out of the tail of each second inner passage successively through each inner discharge orifice, each first inner passage and each second inner passage, while the spinning solution in the outer solution storage chamber 202*a* is sprayed out of the tail of each second outer passage successively through each outer discharge orifice, each first outer passage and each second outer passage. The two-component composite micron and nano fibers of the bilateral structure thus are obtained. In addition, the micron and nano fibers having various bilateral structures may be produced by changing the sectional shapes, sizes, relative positions and relative relation of two parallel passages, i.e., the second inner passage and the second outer passage.

Figure 10:
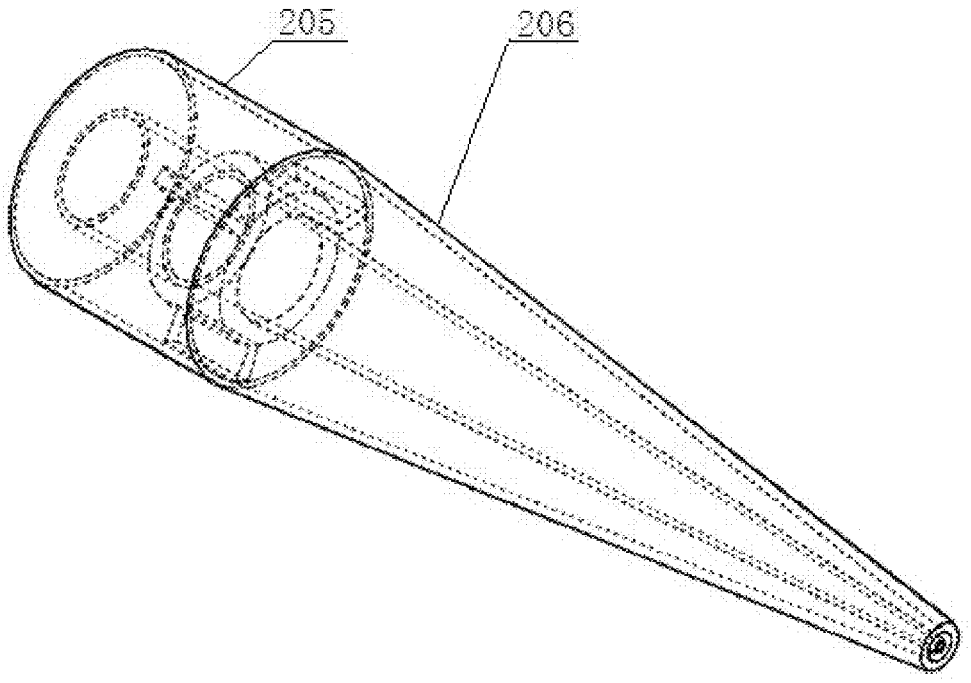
FIG. 10 is a perspective view of a structure relation between a pipe middle portion and a pipe tail portion provided in an embodiment of the present invention when micron and nano fibers collected by collection plates are composite micron and nano fibers of a core-shell structure.
Figure 11:
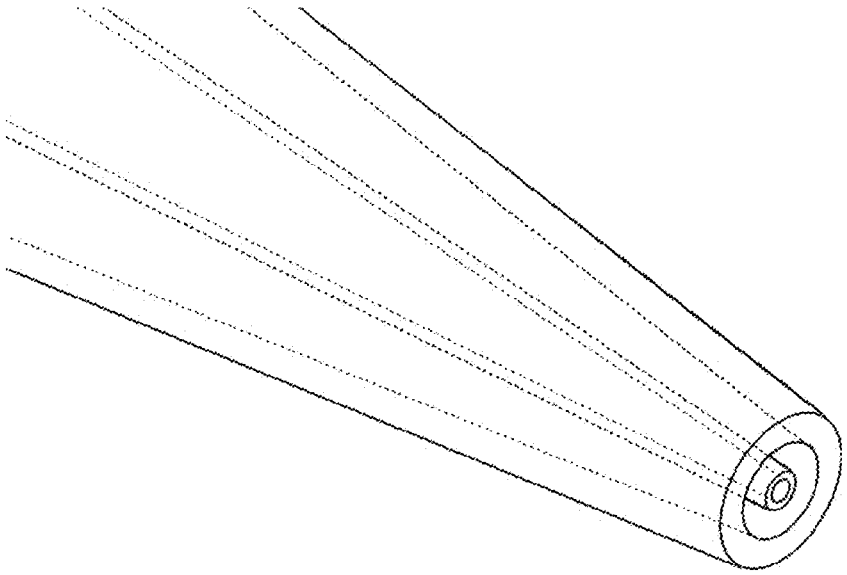
FIG. 11 is a schematic diagram of an enlarged partial structure of the pipe tail portion provided in the embodiment of the present invention when the micron and nano fibers collected by the collection plates are the composite micron and nano fibers of the core-shell structure.
Figure 12:
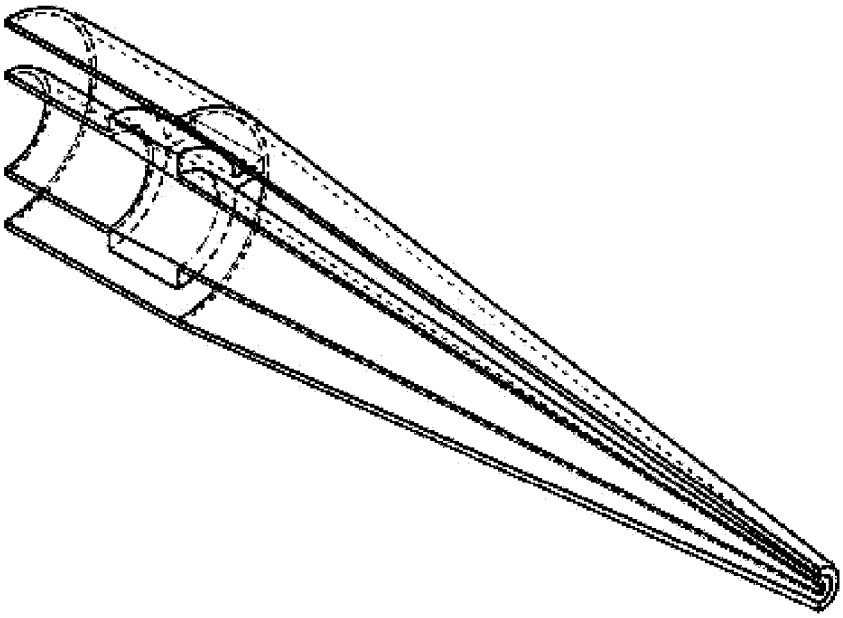
FIG. 12 is an axial sectional view of the structure relation between the pipe middle portion and the pipe tail portion provided in the embodiment of the present invention when the micron and nano fibers collected by the collection plates are the composite micron and nano fibers of the core-shell structure.

4. When the micron and nano fibers collected by the collection plates 7 are composite micron and nano fibers of a core-shell structure, with reference to FIGS. 10-12, each pipe middle portion 205 is composed of a first inner passage and a first outer passage, while each pipe tail portion is composed of a second inner passage and a second outer passage, and the second inner passage and the second outer passage form a passage of the core-shell structure with the second inner passage encompassed by the second outer passage. In this case, under the action of the centrifugal force, the spinning solution in the inner solution storage chamber 201*a* is sprayed out of the tail of each second inner passage successively through each inner discharge orifice, each first inner passage and each second inner passage, while the spinning solution in the outer solution storage chamber 202*a* is sprayed out of the tail of each second outer passage successively through each outer discharge orifice, each first outer passage and each second outer passage. The composite micron and nano fibers of the coaxial structure thus are obtained. In addition, the micron and nano fibers having various core-shell structures may be produced by changing the sectional shapes, sizes, relative positions and relative relation of the tail ends of the second inner passage and the second outer passage.

Figure 13:
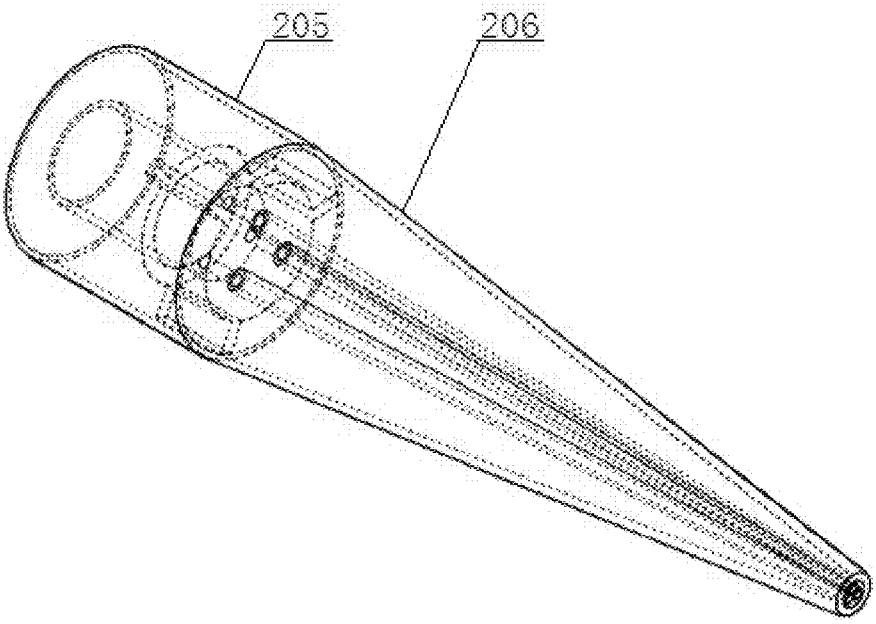
FIG. 13 is a perspective view of a structure relation between a pipe middle portion and a pipe tail portion provided in an embodiment of the present invention when micron and nano fibers collected by collection plates are composite micron and nano fibers of a sea-islands structure.
Figure 14:
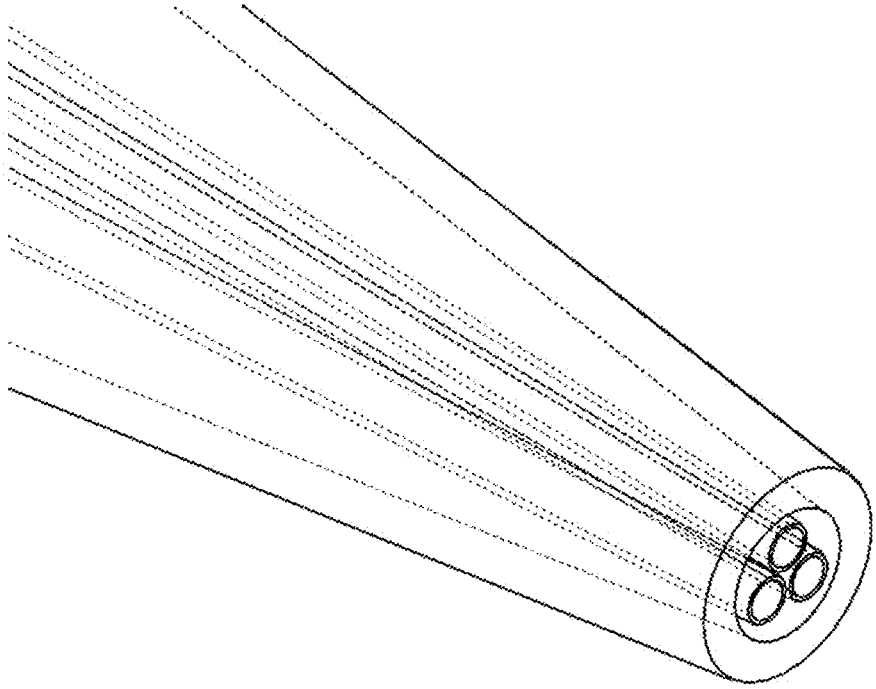
FIG. 14 is a schematic diagram of an enlarged partial structure of the pipe tail portion provided in the embodiment of the present invention when the micron and nano fibers collected by the collection plates are the composite micron and nano fibers of the sea-islands structure.
Figure 15:
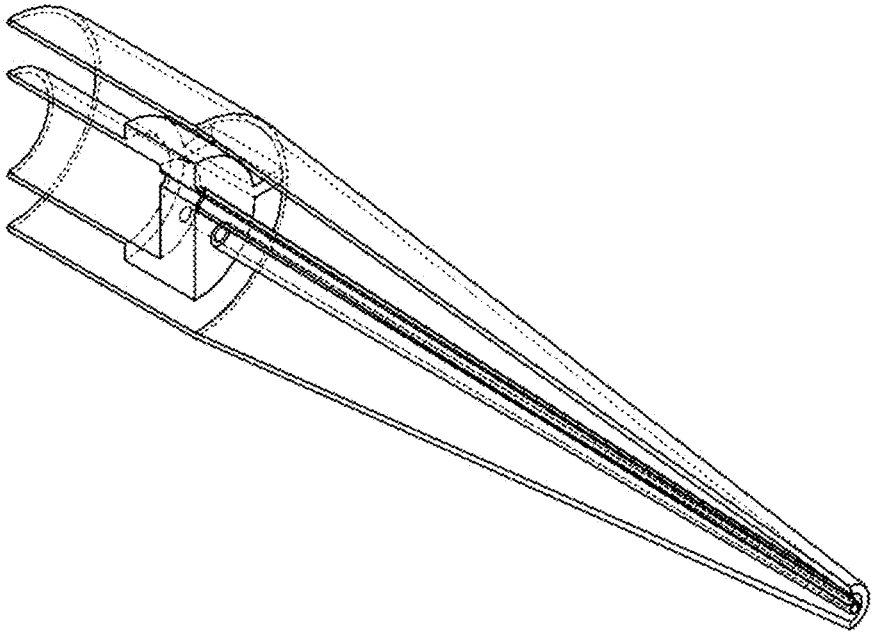
FIG. 15 is an axial sectional view of the structure relation between the pipe middle portion and the pipe tail portion provided in the embodiment of the present invention when the micron and nano fibers collected by the collection plates are the composite micron and nano fibers of the sea-islands structure.

5. When the micron and nano fibers collected by the collection plates 7 are composite micron and nano fibers of a sea-islands structure, with reference to FIGS. 13-15, each pipe middle portion 205 is composed of a first inner passage and a first outer passage, while each pipe tail portion 206 is composed of a second inner passage and a second outer passage (sea passage), and the second inner passage includes several island passages arranged in parallel with any two island passages having pipe walls not in contact with each other. The several island passages are encircled by the second outer passage. In this case, under the action of the centrifugal force, the spinning solution in the inner solution storage chamber 201 a is sprayed out of tails of the corresponding island passages successively through each inner discharge orifice, each first inner passage and each island passage, while the spinning solution in the outer solution storage chamber 202*a* is sprayed out of a tail of each second outer passage successively through each outer discharge orifice, each first outer passage and each second outer passage. In addition, the micron and nano fibers having various core-shell structures may be produced by changing the number of the island passages at the tail ends of nozzles, and the sectional shapes, sizes, relative positions and relative relation of the island-sea passages.

Figure 16:
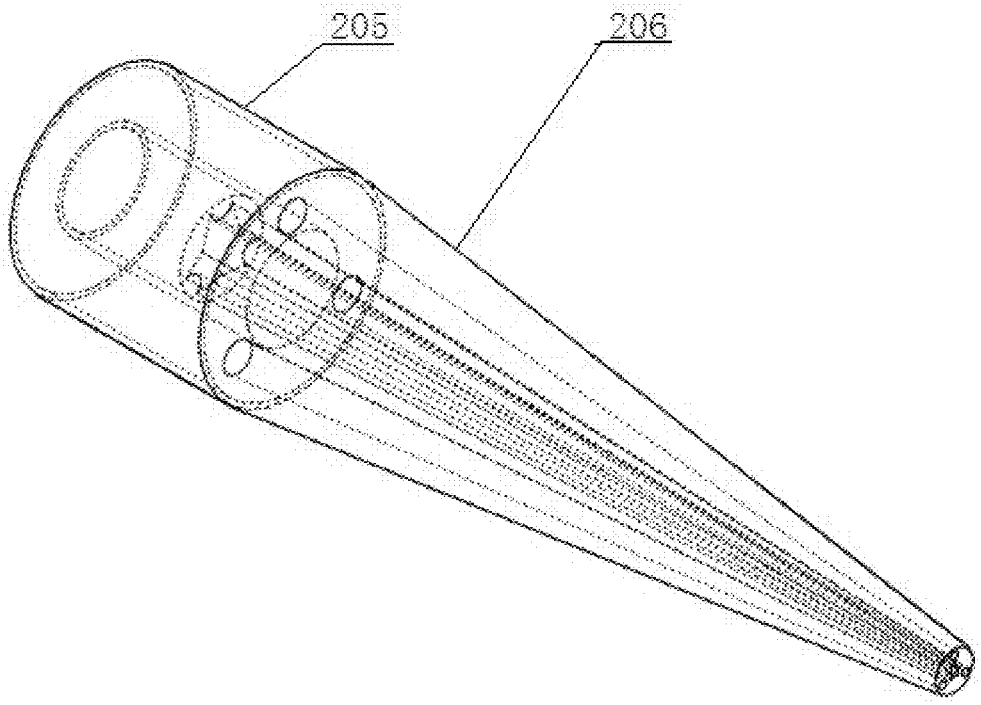
FIG. 16 is a perspective view of a structure relation between a pipe middle portion and a pipe tail portion provided in an embodiment of the present invention when micron and nano fibers collected by collection plates are composite micron and nano fibers of a tip-covered structure.
Figure 17:
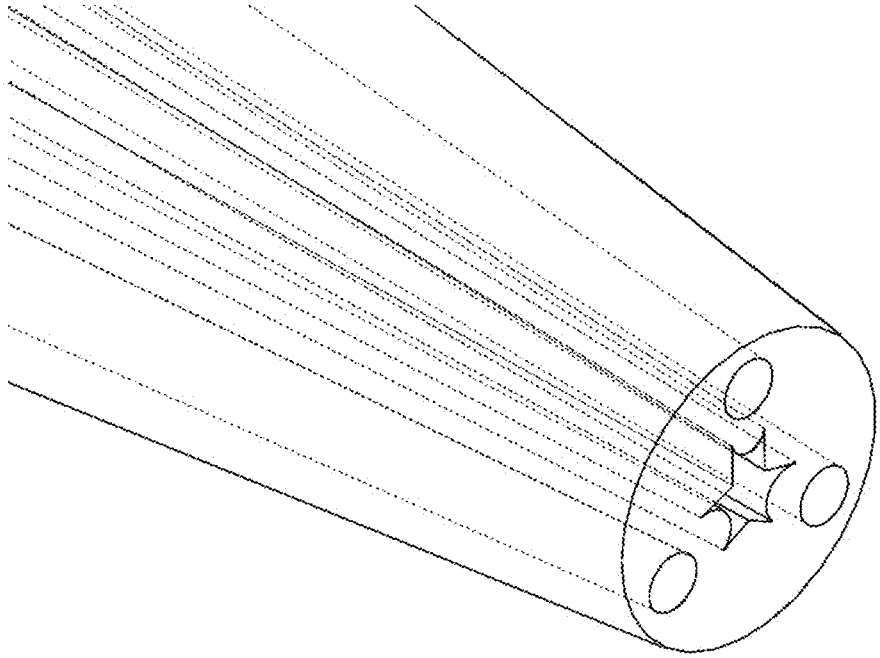
FIG. 17 is a schematic diagram of an enlarged partial structure of the pipe tail portion provided in the embodiment of the present invention when the micron and nano fibers collected by the collection plates are the composite micron and nano fibers of the tip-covered structure.
Figure 18:
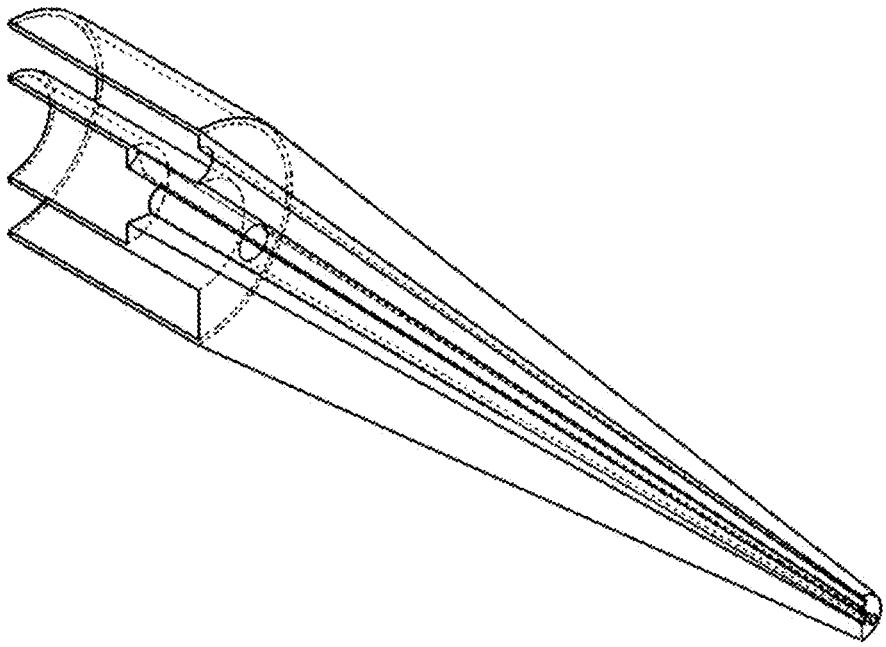
FIG. 18 is an axial sectional view of the structure relation between the pipe middle portion and the pipe tail portion provided in the embodiment of the present invention when the micron and nano fibers collected by the collection plates are the composite micron and nano fibers of the tip-covered structure.
Figure 19:
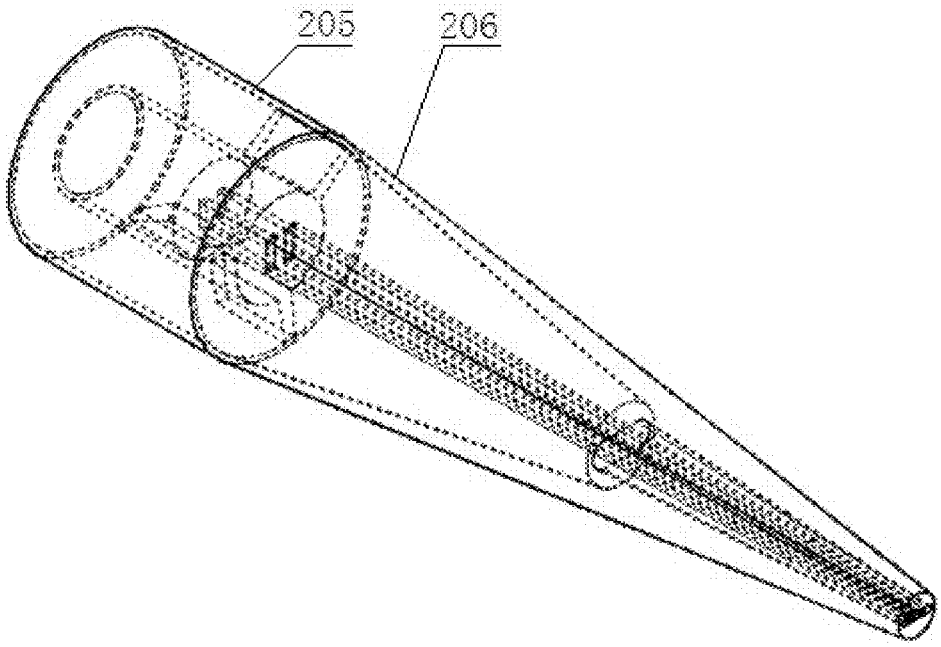
FIG. 19 is a perspective view of a structure relation between a pipe middle portion and a pipe tail portion provided in an embodiment of the present invention when micron and nano fibers collected by collection plates are composite micron and nano fibers of a segmented structure.
Figure 20:
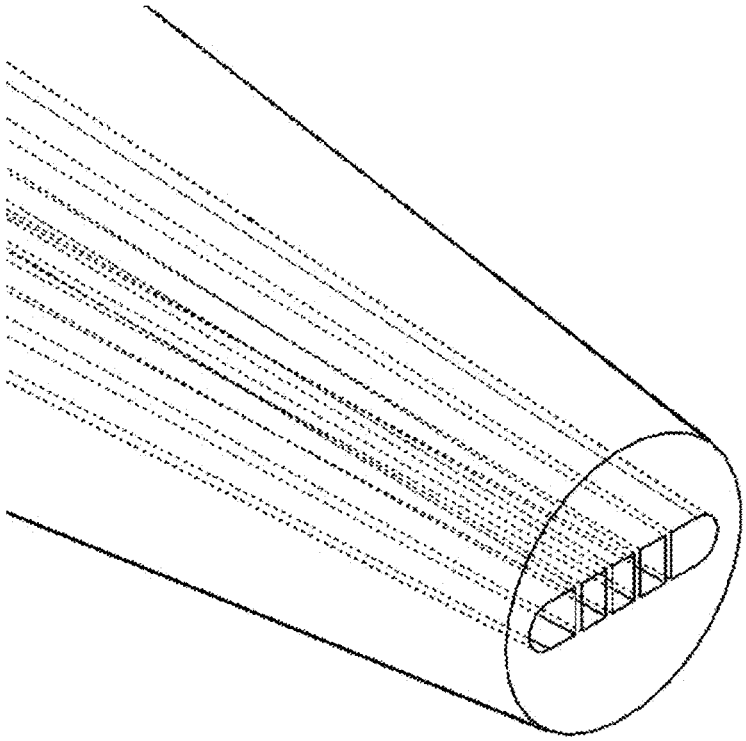
FIG. 20 is a schematic diagram of an enlarged partial structure of the pipe tail portion provided in the embodiment of the present invention when the micron and nano fibers collected by the collection plates are the composite micron and nano fibers of the segmented structure.
Figure 21:
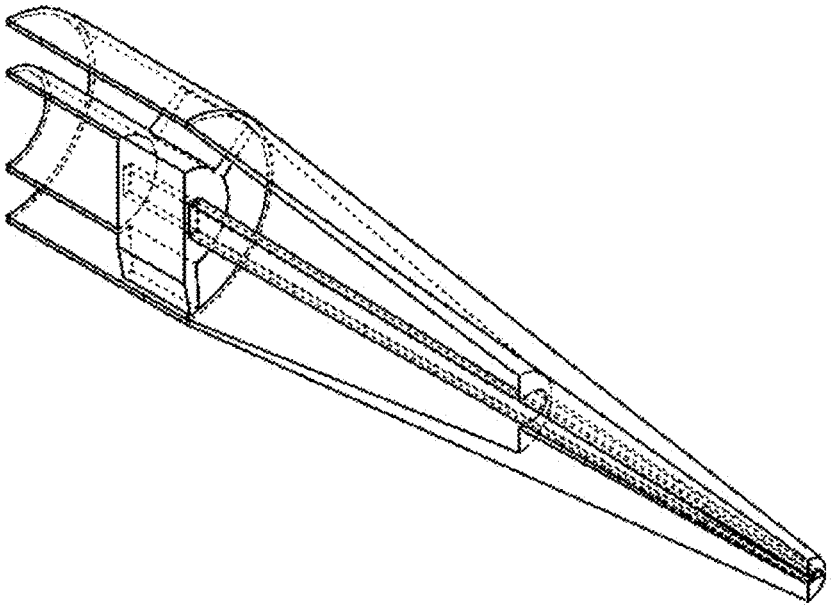
FIG. 21 is an axial sectional view of the structure relation between the pipe middle portion and the pipe tail portion provided in the embodiment of the present invention when the micron and nano fibers collected by the collection plates are the composite micron and nano fibers of the segmented structure.

Similarly, the passage structures in each pipe middle portion 205 and each pipe tail portion 206 may also be designed into other structures to obtain the composite micron and nano fibers of the corresponding structures, for example, the micron and nano fibers of a tip-covered composite structure (please see FIGS. 16-18), the micron and nano fibers of a segmented structure (please see FIGS. 19-21) and the micron and nano fibers of a sea-islands & core-shell structure. With regard to the micron and nano fibers of the tip-covered structure, the inner passage of each pipe middle portion is configured to a pointed main passage, while the outer passage of the same is divided into two or more (covering) sub-passages arranged in parallel, with each sub-passage arranged in parallel to the inner passage and located around one tip of the inner passage. With regard to the composite micron and nano fibers of the segmented structure, the inner passage of the pipe middle portion may be divided into two or more inner sub-passages, while the outer passage of the pipe middle portion closely (seals) encircles the two or more inner sub-passages such that the tail of the outer passage divided by two or more inner sub-passages arranged in parallel into several outer sub-passages; the two or more inner sub-passages are arranged alternately with the two or more outer sub-passages into a segmented form. For the three-component composite micron and nano fibers of the sea-islands & core-shell structure, three drums may be in a nested structure, and the number of the discharge orifices in the discharge orifice groups and the number of the spray passage openings in the spray passage opening groups are correspondingly added; then, the production of the composite micron and nano fibers of the sea-islands & core-shell structure is realized according to the principles of obtaining the micron and nano fibers of the core-shell structure and the sea-islands structure.

It needs to be further noted that in order to further stabilize the firmness degree between the spray passage openings in each spray passage opening group and between the passages in each pipe middle portion 205 and each pipe tail portion 206 and prevent loosening, stiffeners 11 are preferably added between the spray passage openings in each spray passage opening group and between the passages in each pipe middle portion 205 and each pipe tail portion 206 to further improve the stability. Moreover, to facilitate replacement of the pipe middle portions 205 and the pipe tail portions 206 of different structures to obtain the micron and nano fibers of different structures, each spray passage opening in each spray passage opening group is preferably in detachable connection (e.g., threaded connection) with one end of the corresponding pipe middle portion 205.

In this embodiment, the micron and nano fibers of any structure as obtained above can be wound into yarns by paired rollers through barbing or vacuum suction. In addition, a heating device is added to the bottom of the sealing plate 207, and heat-conducting high temperature resistant drums and discharge pipes are adopted, thereby allowing production of the micron and nano fibers of a molten high polymer and metal structure. Additionally, in addition to use in laboratories, this embodiment may be arranged in a production line in the form of a row, a column or an array for large-scale production of composite micron and nano fibers having a single component, two components and the like of various structures The micron and nano fibers have the characteristics of high yield and wide applicability.

In the electrostatic centrifugal multifunctional spinning device provided by the embodiments of the present invention, during actual operation, the first solution infusion set 301, the second solution infusion set 302, the first solution infusion pipe 303 and the second solution infusion pipe 304 correspondingly pour the spinning solutions of different types or different properties into the inner drum 201 and the outer drum 202. The drive apparatus is connected to the power source and the speed of the motor 4 is regulated, and the motor 4 drives the inner drum 201 and the outer drum 202 to rotate at a high speed. In addition, the positive electrode of the high-voltage power source 9 is electrically connected with one end of the current-conducting rod 10. The other end of the current-conducting rod 10 is inserted into any drum (e.g., the inner drum 201) in the solution storage apparatus. The negative electrode of the high-voltage power source 9 and the collection plates 7 are grounded, respectively. The spinning solutions poured into the solution storage chambers are sprayed out of the tail ends of the pipe tail portions after successively passing through the inner and outer spray passage openings in the spray passage opening groups and the pipe middle portions under the combined action of the electrostatic field force (the electrostatic field force produced between the tail ends of the pipe tail portions 206 and the collection plates 7) provided by the high-voltage power supply apparatus and the centrifugal force of rotation provided by the drive apparatus. With the volatilization of the solvent, the spinning solutions are solidified to form fibers deposited on the fiber collecting apparatus, thereby producing a great quantity of micron and nano fibers. Furthermore, the production of single-component, two-component and multi-component micron and nano fibers of various structures can be implemented by changing the passage (the inner passage and the outer passage) structures in each pipe middle portion 205 and each pipe tail portion 206. Compared with the traditional spinning technique, in the present invention, the combined acting force of the electrostatic field force provided by the high-voltage power supply apparatus and the centrifugal force of rotation provided by the drive apparatus is provided as power for the formation of the micron and nano fibers, leading to not only great improvement of the production yield, reduction of the voltage value of the required high-voltage electrostatic field, great reduction of the energy cost, but also improvement of the production safety, and satisfaction of the requirements of large-scale production of the micron and nano fibers of various structures and the mixture thereof.

It needs to be specially explained that the high-voltage power supply apparatus in the embodiment of the present invention may be omitted, i.e., not turning on the high-voltage power supply apparatus, thus obtaining a centrifugal multifunctional spinning device. In this case, except that the high-voltage power supply part is different from that of the above electrostatic-centrifugal multifunctional micron and nano fiber spinning device and the surfaces of the fiber collecting apparatus, the inner drum, the outer drum and the sealing plate and the surfaces of the spray passage pipes in the solution spraying apparatus all are not required to be conductors, the rest functional parts and constitution parts are all identical, which are not described redundantly herein.

Finally, it should be explained that the above specific implementations are merely used for describing, rather than limiting the technical solutions of the present invention. While the present invention is described in detail with reference to examples, those of ordinary skilled in the art will understand that modifications or equivalent substitutions or combination may be made to the technical solutions and dimension scales of the present invention without departing from the spirit and scope of the technical solutions of the present invention and should fall into the scope of the claims of the present invention.

The invention claimed is:

1. A multifunctional spinning device, comprising:

a solution storage apparatus used for storing spinning solutions, wherein space for solution storage in the solution storage apparatus is formed by several drums arranged in a coaxial nesting manner and a sealing plate; the several drums include at least an inner drum and an outer drum; the outer drum sleeves the peripheral part of the inner drum, and the bottom of the inner drum and the bottom of the outer drum are fixedly connected with an upper surface of the sealing plate, respectively; the inner drum and the sealing plate form an inner solution storage chamber; the inner drum, the outer drum and the sealing plate form an outer solution storage chamber; vertical central axes of the outer drum and the inner drum both are located in a same straight line $L_1$;

a solution delivery apparatus that communicates with the solution storage apparatus and is used for delivering the spinning solutions to the solution storage apparatus;

a solution spraying apparatus that is connected to the solution storage apparatus and used for spraying the spinning solutions, and comprises several spray passage opening groups, discharge orifice groups as many as the spray passage opening groups, and spray passage pipe groups as many as the discharge orifice groups, wherein each spray passage opening group is composed of an inner spray passage opening and an outer spray passage opening; each discharge orifice group is composed of an inner discharge orifice and an outer discharge orifice; each spray passage pipe group is composed of a pipe middle portion for delivering the spinning solution and a pipe tail portion for spraying the spinning solution; each pipe middle portion connects the corresponding spray passage opening with the corresponding pipe tail portion into a whole; each inner discharge orifice is formed in a sidewall of the inner drum; each outer discharge orifice is formed in a sidewall of the outer drum; one end of each inner spray passage opening communicates with the corresponding inner discharge orifice; the other end of each inner spray passage opening is formed outside the sidewall of the inner drum or passes through the outer discharge orifice and is formed outside the sidewall of the outer drum or located in the sidewall of the outer drum; one end of each outer spray passage opening communicates with the corresponding outer discharge orifice; each outer spray passage opening is formed outside the sidewall of the outer drum or located in the sidewall of the outer drum, and surrounds the other end of the corresponding spray passage opening; one end of each pipe middle portion is connected to the other end of the corresponding inner spray passage opening and the other end of the corresponding outer spray passage opening, respectively, and the other end of the pipe middle portion is connected to one end of the corresponding pipe tail portion;

a drive apparatus used for driving the solution storage apparatus to rotate such that micron and nano fibers are sprayed from spinning materials in the solution storage apparatus under the action of a centrifugal force of rotation, and coupled with the solution storage apparatus and further connected to an external power output device;

a fiber collecting apparatus used for collecting the micron and nano fibers and disposed around a peripheral part of the solution spraying apparatus;

a housing that comprises an outer cover and an isolation plate, wherein the isolation plate is fixed at a middle lower layer part of the outer cover and used for dividing the outer cover into an upper isolation layer and a lower isolation layer; the solution storage apparatus is disposed in the upper isolation layer, while the drive apparatus is disposed in the lower isolation layer, wherein in the case that several discharge orifice groups, several spray passage opening groups and several spray passage pipe groups are provided in the solution spraying apparatus, the several discharge orifice groups are distributed in the sidewalls of the inner drum and the outer drum in a circle of a same layer or in circles of several layers, while the several spray passage opening groups are distributed in the sidewalls of the inner drum and the outer drum in a circle of a same layer or in circles of several layers, and the several spray passage pipe groups are distributed on the sidewalls of the inner drum and the outer drum in a circle of a same layer or in circles of several layers; and wherein the straight line $L_1$ is perpendicular to the upper surface of the sealing plate; inner space of the inner drum is isolated from inner space of the outer drum; the drive apparatus is connected to the solution storage apparatus and drives the inner drum, the outer drum and the sealing plate to rotate coaxially by means of the external power output device; the solution delivery apparatus communicates with the inner solution storage chamber and the outer solution storage chamber, respectively; each outer discharge orifice and each inner discharge orifice are arranged coaxially with a diameter of the outer discharge orifice greater than a diameter of the inner discharge orifice; central axes of the inner spray passage opening and the outer spray passage opening are distributed at an included angle $\alpha$ to the straight line $L_1$, wherein $0° < \alpha < 180°$.

2. The multifunctional spinning device according to claim 1, wherein when the micron and nano fibers collected by collection plates are constituted by the spinning material in the inner solution storage chamber, each pipe middle portion is composed of a first inner passage and a first outer passage, while each pipe tail portion is formed by a hollow passage, and the first outer passage is in a sealed condition; one end of the first inner passage communicates with the corresponding inner discharge orifice, while the other end of the first inner passage communicates with the hollow passage; the spinning material in the inner drum is sprayed out of a tail end of each hollow passage successively through each inner discharge orifice and each first inner passage.

3. The multifunctional spinning device according to claim 1, wherein when the micron and nano fibers collected by the collection plates are constituted by the spinning material in the outer solution storage chamber, each pipe middle portion is composed of a first inner passage and a first outer passage, while each pipe tail portion is formed by a hollow passage, and the first inner passage is in a sealed condition; one end of the first outer passage communicates with the corresponding outer discharge orifice, while the other end of the first outer passage communicates with the hollow passage; the spinning material in the outer solution storage chamber is sprayed out of a tail end of each hollow passage successively through each outer discharge orifice and each first outer passage.

4. The multifunctional spinning device according to claim 1, wherein when the micron and nano fibers collected by the collection plates are composite micron and nano fibers of a bilateral structure, each pipe middle portion is composed of a first inner passage and a first outer passage, while each pipe tail portion is composed of a second inner passage and a second outer passage, and the second inner passage and the second outer passage form a passage of a bilateral parallel structure; the spinning material in the inner solution storage chamber is sprayed out of a tail of each second inner passage successively through each inner discharge orifice, each first inner passage and each second inner passage, while the spinning material in the outer solution storage chamber is sprayed out of a tail of each second outer passage successively through each outer discharge orifice, each first outer passage and each second outer passage.

5. The multifunctional spinning device according to claim 1, wherein when the micron and nano fibers collected by the collection plates are composite micron and nano fibers of a core-shell structure, each pipe middle portion is composed of a first inner passage and a first outer passage, while each pipe tail portion is composed of a second inner passage and a second outer passage, and the second inner passage and the second outer passage form a passage of the core-shell structure with the second inner passage encompassed by the second outer passage; the spinning material in the inner solution storage chamber is sprayed out of a tail of each second inner passage successively through each inner discharge orifice, each first inner passage and each second inner passage, while the spinning material in the outer solution storage chamber is sprayed out of a tail of each second outer passage successively through each outer discharge orifice, each first outer passage and each second outer passage.

6. The multifunctional spinning device according to claim 1, wherein when the micron and nano fibers collected by the collection plates are composite micron and nano fibers of a sea-islands structure, each pipe middle portion is composed of a first inner passage and a first outer passage, while each pipe tail portion is composed of a second inner passage and a second outer passage, and the second inner passage includes several island passages arranged in parallel with any two island passages having pipe walls not in contact with each other; the several island passages are encompassed by the second outer passage; the spinning material in the inner solution storage chamber is sprayed out of tails of the corresponding island passages successively through each inner discharge orifice, each first inner passage and each island passage, while the spinning material in the outer solution storage chamber is sprayed out of a tail of each second outer passage successively through each outer discharge orifice, each first outer passage and each second outer passage.

7. The multifunctional spinning device according to claim 1, wherein when the micron and nano fibers collected by the collection plates are composite micron and nano fibers of a tip-covered structure, each pipe middle portion is composed of a first inner passage and a first outer passage, while each pipe tail portion is composed of a second inner passage and a second outer passage, and the second inner passage is provided with several tips at a cross-section thereof, while the second outer passage includes several sub-passages arranged in parallel with any two sub-passages isolated from each other; each sub-passage is arranged in parallel to the corresponding second inner passage, respectively, and located around one tip of the second inner passage, with the number of the sub-passages identical to the number of the tips at the cross-section of the second inner passage; the spinning material in the inner solution storage chamber is sprayed out of a tail of each second inner passage successively through each inner discharge orifice, each first inner passage and each second inner passage, while the spinning material in the outer solution storage chamber is sprayed out of tails of the corresponding sub-passages successively through each outer discharge orifice, each first outer passage and each sub-passage.

8. The multifunctional spinning device according to claim 1, wherein when the micron and nano fibers collected by the collection plates are composite micron and nano fibers of a segmented structure, each pipe middle portion is composed of a first inner passage and a first outer passage, while each pipe tail portion is composed of a second inner passage and a second outer passage, and the second inner passage includes several inner sub-passages arranged in parallel with any two inner sub-passages isolated from each other and having sidewalls not in contact with each other; pipe walls of all the inner sub-passages are closely encompassed by a tail of the second outer passage such that the tail of the second outer passage is divided into several outer sub-passages by the sidewalls of the several inner sub-passages arranged in parallel, and the several inner sub-passages and the several outer sub-passages are arranged alternately into a segmented form; the spinning material in the inner solution storage chamber is sprayed out of a tail of each inner sub-passage successively through each inner discharge orifice and each first inner passage, while the spinning material in the outer solution storage chamber is sprayed out of a tail of each second outer inner-passage successively through each outer discharge orifice and each first outer passage.

* * * * *